US006643997B1

(12) United States Patent
Schwenke et al.

(10) Patent No.: US 6,643,997 B1
(45) Date of Patent: Nov. 11, 2003

(54) METHOD AND DEVICE FOR ADAPTING THE VOLUME OF COLLAR BAG AND COLLAR BAG THUS USED

(75) Inventors: Dieter Schwenke, Schenefeld (DE); Robert Oster, Bornheim (DE); Jurgen Tegtmeyer, Sankt Augustin (DE)

(73) Assignee: Chronos Holdings Ltd. (GB)

( * ) Notice: Subject to any disclaimer, the term of this patent is extended or adjusted under 35 U.S.C. 154(b) by 0 days.

(21) Appl. No.: 09/889,334

(22) PCT Filed: Feb. 3, 2000

(86) PCT No.: PCT/DE00/00323

§ 371 (c)(1),
(2), (4) Date: Oct. 19, 2001

(87) PCT Pub. No.: WO00/46105

PCT Pub. Date: Aug. 10, 2000

(30) Foreign Application Priority Data

Feb. 4, 1999 (DE) ..... 199 04 429

(51) Int. Cl.[7] ..... B65B 61/24; B65B 7/08; B65B 7/28

(52) U.S. Cl. ..... 53/482; 53/376.5; 53/377.4

(58) Field of Search ..... 53/480, 476, 481, 53/482, 375.5, 374.4, 376.5, 377.4, 415, 436, 526, 527, 528

(56) References Cited

U.S. PATENT DOCUMENTS 1,491,269 A * 4/1924 Joplin ..... 53/461
2,176,996 A * 10/1939 Leonard et al. ..... 53/480
2,319,956 A * 5/1943 Snyder ..... 53/440
2,689,438 A * 9/1954 Kindseth ..... 53/480
3,035,938 A * 5/1962 Schwinger ..... 53/372.6
3,286,432 A * 11/1966 Long ..... 53/480
3,383,832 A * 5/1968 Grant et al. ..... 53/209
3,397,622 A * 8/1968 Goodwin ..... 493/189
3,771,280 A * 11/1973 Bechle ..... 53/461
3,812,644 A * 5/1974 Kamikawa et al. ..... 53/459
4,580,391 A * 4/1986 Tetenborg et al. ..... 53/375.7
4,704,845 A * 11/1987 Bruno ..... 53/482
4,785,609 A * 11/1988 Widmann ..... 53/461
4,872,303 A * 10/1989 Johnson ..... 53/481
5,351,463 A * 10/1994 Aarts ..... 53/434
5,671,593 A * 9/1997 Ginestra et al. ..... 53/504
5,913,764 A * 6/1999 Kolbe et al. ..... 493/218

* cited by examiner

*Primary Examiner*—Stephen F. Gerrity
*Assistant Examiner*—Paul Durand
(74) *Attorney, Agent, or Firm*—Marianne Fuierer; Steven J. Hultquist; Yongzhi Yang

(57) ABSTRACT

A method for adapting the volume of a collar bag (1) that is partially filled with bulk material, whereby the collar (3) of said bag is formed by two opposite-lying outwardly bent edge strips (5) and two opposite-lying inwardly bent second edge strips (7), to the volume of the bulk material contained in said bag (1). The invention is characterized in that the first edge strips (5) are pulled apart, whereby the wall of the bag is drawn out of the upper unfilled part of the bag over the folded edges (6) and into the collar (3) or the cross-section of the bag is reduced by pressing the opposite-lying larger parts of the wall. The invention also relates to the collar bag (1) and the device to carry out the above-mentioned method.

7 Claims, 6 Drawing Sheets

METHOD AND DEVICE FOR ADAPTING THE VOLUME OF COLLAR BAG AND COLLAR BAG THUS USED

Figure 1:
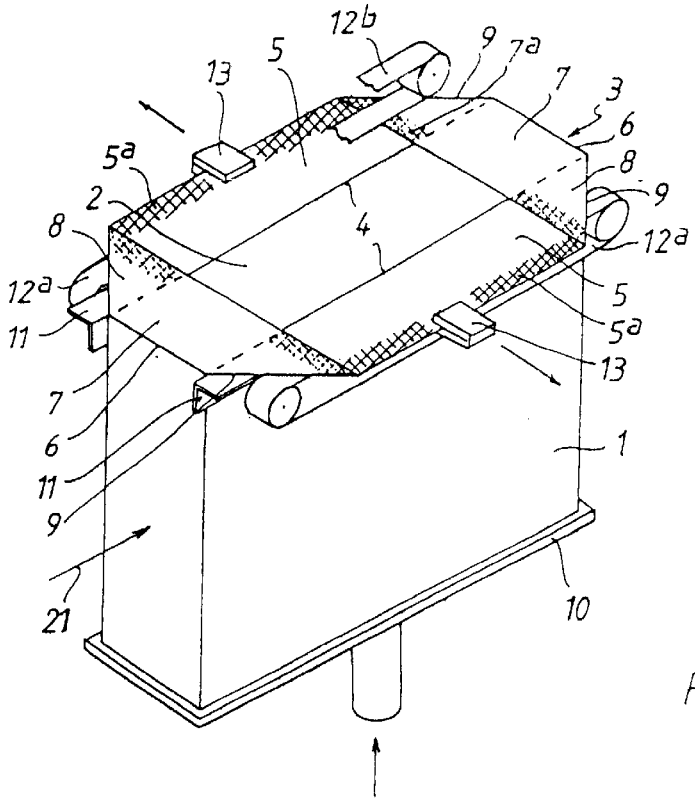

This application is filed under the provisions of 35 U.S.C. §371 and claims the priority of International Patent Application No. PCT/DE00/00323 filed Feb. 3, 2000, which in turn claims priority of German Patent Application No. 199 04 429.5 filed Feb. 4, 1999.

The invention relates to a process for adjusting the volume of a collared sack or bag, incompletely filled with bulk material, the collar of which is formed by two mutually opposed first peripheral strips, folded outwards, and two mutually opposed second peripheral strips, folded inwards, to the volume of the bulk material located in the sack or bag. The invention further relates to a device for the performance of this process and a sack or bag which can be used in this situation.

The advantage with the use of valve sacks or bags lies in the low emergence of dust during filling and in the good stacking and palletising characteristics. However, when being filled with a bulk material of fluctuating density a valve sack or bag is often incompletely filled when the density of the bulk material rises. The consequence of the incomplete filling of the sack or bag is air in the head of the sack or bag above the bulk material. The enclosed air has a sponge-like effect on the contents of the sack or bag. Safe and reliable palletising and handling of such sack or bags is not possible.

With an open sack or bag, the filling speed can be substantially increased in comparison with that of a valve sack or bag. The emergence of dust, however, is considerable unless special measures are taken. If an open sack or bag is used with the length required for the greatest possible filling volume, then, after filling with a bulk material of greater density and correspondingly less filling volume than is inherently provided for, the sack or bag is pressed together and the sack or bag length reduced by cutting off the overlap, to the dimension necessary for reliable closure. The sack or bag which is adjusted in this way to the filling volume is difficult to load on pallets, since it may have a flat bottom, but on the top it is generally wedge-shaped.

From DE 198 40 792.0 and 198 40 793.9 a collared sack or bag is known, as well as a process and device for transporting, checking, filling, and closing a collared sack or bag. This sack or bag combines the advantages of the open sack or bag and the valve sack or bag, in that it is characterised by a large filling cross-section and the possibility of a dust-tight closure during the filling process. Due to the partial closure which is already effected before filling, however, this sack or bag is designed for a specific volume, which cannot be adjusted. Accordingly, if the density of the bulk material rises above the value provided for, this sack or bag too will only be incompletely filled. It may therefore have similarly disadvantageous handling properties as the incompletely filled valve sack or bag.

DE 198 40 793 A1 relates to a process and device for transporting, checking, filling, and closing a sack or bag. The sack or bag features a sack or bag body capable of being spread to form a rectangular cross-section, formed of two wide first sack or bag walls and two narrow second sack or bag walls, a sack or bag base closed at the bottom, a sack or bag opening delimiting the sack or bag body at the top, and an open sack or bag closure arrangement, whereby the sack or bag closure arrangement comprises in turn first closure flaps, which in each case connect to the first sack or bag walls and project outwards at right angles to the first sack or bag walls, horizontally from the sack or bag opening, two closure flaps, which in each case connect to the second sack or bag walls, and which fold over inwards onto the sack or bag opening, lying horizontal, so that the first closure flaps and the second closure flaps form a frame-shaped sealing collar lying in a horizontal plane, in which the outer areas of the first closure flaps are retained by conveying media capable of being actuated by a drive.

The present invention is based on the problem of creating a process for adjusting the volume of a filled collared sack or bag to the volume of the bulk material contained in the sack or bag, so that handling disadvantages as a consequence of incomplete filling or of a volume of air in the head of the sack or bag are avoided with this sack or bag. In addition, good retention of the closure should be achieved, despite the reduction in the volume or the reduction of the sack or bag length. In addition to this, the advantages of the collared sack or bag in comparison with the valve sack or bag and the open sack or bag should be retained, i.e. a sack or bag should be created which, in addition to a large filling cross-section and a dust-tight closure, also allows, during filling, for a reduction of the sack or bag volume to the filling volume actually contained. In addition, a sack or bag should be created which, despite the adjustment of the volume, has good palletising properties. In particular, the cutting of sack or bag material and therefore the loss of material should be avoided. A device should also be created for adjusting the volume of a collared sack or bag, which can be integrated into a continuously operating filling system for collared sack or bags. Finally, a new sack or bag should be created which is capable of being easily handled during the preparation for filling, during the filling itself, and during the following process stages, in particular during closing. This sack or bag should be created in such a way that it can be filled without any emergence of dust, and the closure surfaces of the sack or bag (by adhesive bonding or welding) are not impaired by layers of dust. The sack or bag should therefore be capable of being well sealed in a simple manner, for preference on a flat surface. Finally, a sack or bag should be created of which the closure volume is capable of being adjusted to the actual filling volume.

This problem is resolved according to the invention by the process referred to in the preamble, in that the first peripheral strips are drawn apart from one another, and, in this situation, the sack or bag wall of the upper part of the sack or bag, which remains unfilled, is drawn over the fold edges into the collar, or the sack or bag cross-section is reduced by pressure on the larger mutually opposed sack or bag wall parts. To draw the first peripheral strips apart, they are in general gripped in the centre. For preference, they are drawn apart at right angles to the mid-plane of the sack or bag, or to the sack or bag wall connected to the first peripheral strips. Other drawing angles are also possible. As a departure from the open sack or bag, with the overlap being cut off, the unfilled and therefore superfluous part of the sack or bag is transformed into the sack or bag collar, to that this gains in its width what the sack or bag loses in its length. In this situation, at the same time the free cross-section of the sack or bag opening is reduced, and the initially unfilled sack or bag volume disappears.

Due to the central engagement at the first peripheral strips, the shortening of these strips with the corresponding lengthening of the second peripheral strips is in general possible without hinderance by the engaging grip elements. The first peripheral strips are in general drawn apart in opposite directions. From the widened collar, the closure is formed, which acquires added resistance and stability in comparison with a non-widened collar. When the strips are drawn apart, the folding edges are displaced towards the base of the sack or bag. As the cross-section of the sack or bag diminishes due to the pressing on its broad sides, the level of the filling material rises, as a result of which the upper air pockets disappears. This design requires a sufficient flow capacity of the filling material, so that the sack or bag does not tear at the side.

According to a preferred embodiment of the process according to the invention, at the same time as the first peripheral strips are drawn apart the base of the sack or bag is raised by the drawing distance of one of these peripheral strips. When the sack or bag wall is drawn into the collar, the sack or bag wall is relieved of the weight of the sack or bag. In this way the risk can be avoided of the first peripheral strips being torn or damaged as a result of the weight of the sack or bag.

According to the preferred embodiment of the process, the first peripheral strips are drawn apart laterally. The direction of pull in general forms an angle of between 70 and 110° with the mid-plane of the sack or bag, and in particular an angle of 90°. The transformation according to the invention of the sack or bag wall into the sack or bag collar requires as a precondition a flexible sack or bag wall/collar material. This material is for preference a multi-layered paper or a plastic film.

For preference, after the first peripheral strips have been drawn apart, the first and second peripheral strip parts located on top of one another in the four gussets are at least in part connected. The filled sack or bag, shortened according to the invention, is in this way partially closed, since only the reduced opening remaining between the inner edges of the second sack or bag strips remains to be closed. To the purpose, this connection of the superimposed peripheral strip parts is effected by thermal activation of a hot melt adhesive applied on the upper side of the first peripheral strips. This activation can be effected, for example, by lowering and pressing down a hot plate, by means of an infra-red radiation device, or the like. In the case of sack or bags with plastic films, this connection can be effected by welding.

To the purpose, the peripheral strips are coated with adhesive for the purpose of closing the sack or bag after being drawn apart, and a cover sheet is applied. This cover sheet serves to close the sack or bag opening cross-section still remaining. The first peripheral strips are then folded in or folded over, coated with adhesive, and again folded over and pressed down. This causes the drawn-apart sack or bag collar to be formed into a stable sack or bag closure within the scope defined by the sack or bag cross-section. When a longitudinal cover sheet is applied, extending as far as the outer edge of a first peripheral strip, the possibility pertains, by the partial opening of the closure and cutting off the edge, of creating a discharge opening, which is capable of being closed again in a simple manner such as to be odour-tight.

For preference, the reduction of the cross-section of the sack or bag is achieved in that pressure is exerted by a progressive upwards pressing of the sack or bag. In this way, bulk material in the sack or bag is pushed upwards, without a pressure pertaining in the lower part of the sack or bag which might possibly lead to the bursting of the sack or bag wall. As a departure from the shortening of the sack or bag by drawing in the upper sack or bag wall into the collar, with this process a certain flow capacity of the bulk material is required. The reduction of the cross-section of the sack or bag also smooths out any bulges in the large sack or bag walls, i.e. the shape of the sack or bag approximates more closely a cube, as a result of which the sack or bag is better suited for stacking and palletisation. For preference, the pressing is effected by a horizontal pressing zone progressing in a vertical direction. It is of course also possible for the pressure to be exercised flat onto both the mutually opposed sack or bag sides, whereby the pressing of the surface commences in the vicinity of the bottom of the sack or bag and the pressing surface becomes larger in an upwards direction.

The problem is resolved according to the invention by a collared sack or bag, of which the collar is formed at the sack or bag opening by two mutually opposed first peripheral strips and two mutually opposed second peripheral strips, of which the first peripheral strips are folded outwards and the second peripheral strips are folded inwards (towards the opening), and the transitions from a first to a second peripheral strip are formed by double-layer gussets, of which the lower layers are connected to a first peripheral strip and of which the upper layers are connected to a second peripheral strip. The collar formed at the sack or bag opening may of course have a different angular position in relation to the sack or bag walls. The collar can in particular have different angular positions in relation to the sack or bag body at the different stages of the filling process, which may also deviate from the horizontal position. In general, the upper side of the collar lies in one plane. The sealing of the sack or bag during filling is effected on the upper side of the sack or bag collar. The sack or bag collar can be formed at the opening periphery by simple folds. It can in particular already be formed during the manufacture of the sack or bag by means of folds, so that it is easily possible for it to be set open in the course of the preparation and filling of the sack or bag, and can be effected by appropriate mechanical guide elements.

In one embodiment of the collared sack or bag, the two layers of the gusset are not connected on the surface, and are therefore capable of being displaced against one another. For preference, the two layers of each gusset are connected by means of common folding edges, the arrangement and lengths of which are capable of being changed by drawing forces applied to both first peripheral strips, directed away from the sack or bag opening. As the first peripheral strips are drawn apart, the two layers of the sack or bag wall material slide on one another in the gussets. In this situation, the inner edges of the second peripheral strips approach one another, whereby the sack or bag opening is drawn from its narrow sides towards a residual opening. In this situation the sack or bag walls are drawn over the fold edges into the sack or bag collar, whereby the sack or bag loses length. The unconnected gusset layers are therefore a precondition for a sack or bag which is capable of adjustment to the actual filling volume. The tension forces engaging at the first peripheral strips and the flexibility of the sack or bag wall material are required for the displacement of the four gusset fold edges and are sufficient for this.

In the preferred embodiment of the collared sack or bag according to the invention, the two first peripheral strips feature on the upper side, at least in part, an activatable layer of adhesive. To the purpose, the two second peripheral strips feature on the under side, at least in part, an activatable layer of adhesive. After the first peripheral strips have been drawn apart and the sack or bag length has therefore been adjusted to the volume actually contained in the sack or bag, the connection of the superimposed gusset layers for the purpose of sealing can then take place. The adhesive coating serves this purpose, which is now activated, e.g. thermally, as a result of which the gussets are closed, for example along the inner edge of the second peripheral strip. As a result of this, the connection from the inside of the sack or bag through the gusset to the outside is blocked, so that only a small central sack or bag opening remains to be closed.

In a further embodiment of the collared sack or bag, the two gusset layers are already connected at the time of manufacture in a releasable manner. A displacement of the gusset fold edges and of the fold edges, and therefore the shortening of the sack or bag as described heretofore is then in general not possible, unless the connection of the gusset layers is temporarily released by the application of the tensile stress referred to, and after the shortening of the sack or bag in another arrangement can be created again by activation. The activation is effected to the purpose by the effect of heat and, if appropriate, pressure. The collared sack or bag according to the invention may consist of paper or plastic film.

According to a further embodiment of the collared sack or bag, at least one of the two first peripheral strips is widened and the gap between these peripheral strips and the upper layers of the connected gussets are sealed by sheets being adhesively bonded to them The connection of the inside of the closed sack or bag with the outside atmosphere between the two layers through the gusset is in this way blocked. Instead of being adhesively bonded, the sheets can also be secured on the gaps by other means, depending on the material of the sack or bag wall, in such a way as to create a seal, for example by welding. The widening of the first peripheral strip(s) can be achieved, for example, by a stepped cut of the multi-layered sack or bag material. One of the sack or bag wall layers is then superimposed on the other sack or bag wall layer(s) and so creates the widening. This widening is required in order for the gap to be covered by the sheet applied, over its entire length and beyond, and a complete gap closure is therefore possible.

For preference, provision is made with this embodiment for the widened first peripheral strip, the upper layer of the adjacent gusset, and the second peripheral strip to be provided with an adhesive trace on the upper side. This adhesive trace can be activated, for example, by heat or by the effect of moisture, so that the collar forms a tight seal after the corresponding folding in of the first peripheral strips. Instead of the adhesive trace applied in the course of the manufacture of the sack or bag, the sack or bag closure may also be effected by adhesive applied after filling or by ultrasonic welding.

In general, every gap will be closed by a separate sheet. With the widening of only one of the first peripheral strips, two sheets are accordingly required to seal the two gaps; with widening on both sides of the first peripheral strips, a total of four sealing sheets are required for sealing the gaps on all four gussets. Instead of the two separate sheets on a widened first peripheral strip, it is also possible for one single long sheet to be applied, which covers and seals both the gaps on the peripheral strips.

The problem is finally resolved according to the invention with the device described in the preamble, in that a) the retaining and transport media are capable of being brought into and out of engagement with the first peripheral strips, and are provided on their outsides, transverse to the direction of transport, with movable grip elements, or b) pressure bodies are arranged beneath the retaining and transport media. The shortening of the sack or bag to the actual filling height can be effected in the filling station subsequent to the filling with bulk material, or, for preference, in a subsequent station before the formation of the closure. The first peripheral strips of the sack or bag collar must have a sufficient width for them to provide an adequate engagement surface for the grip elements, even outside the retention and transport media. For the shortening of the sack or bag, the retention and transport media release the first peripheral strips after, during, or before the grip elements have taken hold of these peripheral strips. The grip elements then move apart and draw the superfluous sack or bag wall into the collar. In general, the mutually opposed grip elements move laterally, for preference perpendicular to the mid-plane of the sack or bag. The grip elements may however also be capable of movement, after the engagement of the first peripheral strips, parallel to the mid-plane of the sack or bag, if appropriate devices are provided for the further deflection of the first peripheral strips. In principle, this shortening of the sack or bag can be achieved by raising the sack or bag by the shortening distance, by means of the grips, particularly with lower filling weights. For preference, however, a sack or bag carrier is arranged so as to be capable of vertical movement beneath the retaining and transport media, which takes the weight of the sack or bag. In this situation, the movements of the grip elements and of the sack or bag carrier are synchronised and their lifting stroke distance is essentially of equal length. The lifting work is performed by the sack or bag carrier, while the grip elements perform only the (essentially lesser) shaping work on the sack or bag wall material. In this way the risk can be avoided of the first peripheral strips suffering damage when drawn apart, if sack or bags with higher filling weights are being shortened in the manner according to the invention. The maximum stroke distance of a grip element or of the sack or bag carrier is equal to half the length of the first peripheral strip of the sack or bag collar; by means of such a stroke the sack or bag opening is entirely pulled closed by the second peripheral strips by means of a two-part curtain element.

For preference the retention and transport media are formed on both sides of the sack or bag by one pairs of belts in each case, which between them accommodate one of the two first peripheral strips. One belt of the pair of belts, for preference the upper belt, is capable of being moved vertically, so that the peripheral strips are clamped in the pair of belts for the purpose of retention and transport, or can be released for the purpose of shortening the sack or bag by drawing in the superfluous sack or bag wall into the collar. It is also possible for other transport media to be used for the transport of the sack or bags, apart from pairs of belts running on top of one another.

According to the preferred embodiment of the device according to the invention, support rails are arranged on the insides of both retaining and transport media, running in the transport direction. These rails not only provide a bearing surface when pressing down the seal of the filling nozzle onto the sack or bag sleeve, but they also have the effect, when the sack or bag is being shortened, of providing a precise deflection of the sack or bag wall material in the collar.

For preference, in order to control the stroke length of the grip elements and the stroke of the sack or bag carrier, at least one filling sensor is provided for, which supplies a signal which is dependent on the actual filling status in the filled sack or bag; this signal can then be used to control the stroke of the grip elements or of the sack or bag carrier. As an alternative it is also possible for the maximum drawing force which can be exercised by the pneumatically actuated grip elements to be limited. The drawing movement of the grip elements then stops automatically when the superfluous sack or bag wall is drawn into the collar and the further drawing movement comes to a stop due to mechanical resistance as a result of the upper side of the bulk material coming in contact with the second peripheral strips, which are folded inwards.

With a further embodiment of the device according to the invention, the pressure bodies are a pair of pressure elements which are capable of being brought into contact with the two sack or bag wall parts, and which are capable of being moved perpendicular and parallel to the axis of the sack or bag. The ability to move perpendicular to the axis of the sack or bag allows for an adjustable reduction in the cross-section of the sack or bag, so that the empty volume which is initially available above the level of the bulk material in the sack or bag will be filled up with the rising bulk material. The horizontal distance between the two pressure elements will therefore be controlled by the height of the empty volume of the sack or bag which is to be filled, whereby this height is determined by a suitable sensor. The ability of the pressure elements to move parallel to the axis of the sack or bag is necessary in order for the bulk material to settle in the sack or bag and for the progressive shaping of the sack or bag to take place. To the purpose, the pressure elements are a pair of rollers mounted on bearings so as to be rotatable. As a result of this, the friction of the elements on the sack or bag wall is avoided and the wall is subjected to less stress during the shaping of the sack or bag.

To the purpose, a heating device and/or an adhesive application device is allocated to the device according to the invention. As a result of the heating device, the hot melt adhesive strips on the peripheral strips can be activated, and the gusset layers can be adhesively bonded to one another. The adhesive application device allows for the application of an adhesive to secure a cover sheet as well as to create the sack or bag closure.

Figure 2:
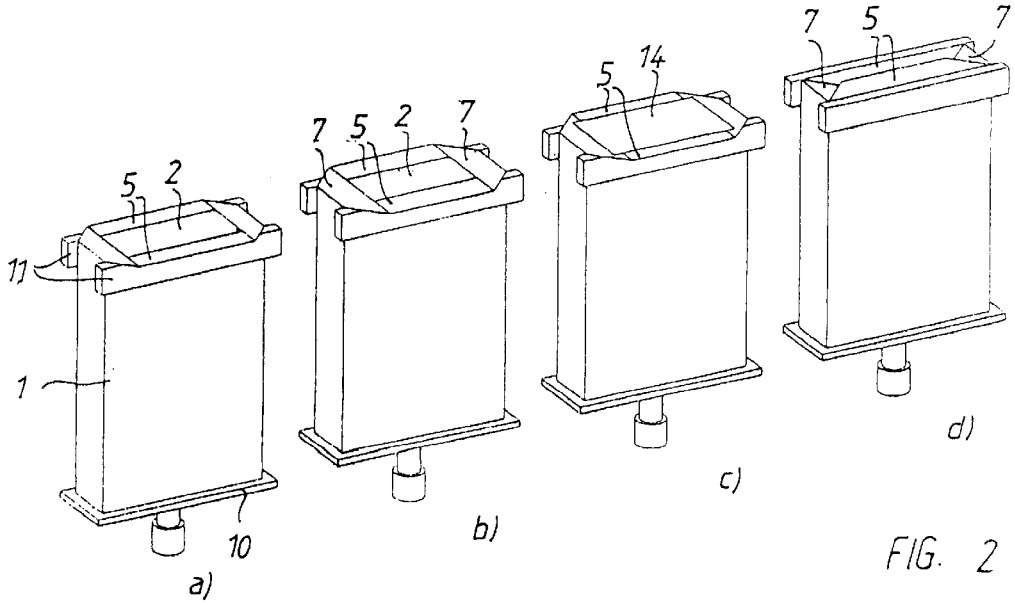
Figure 3:
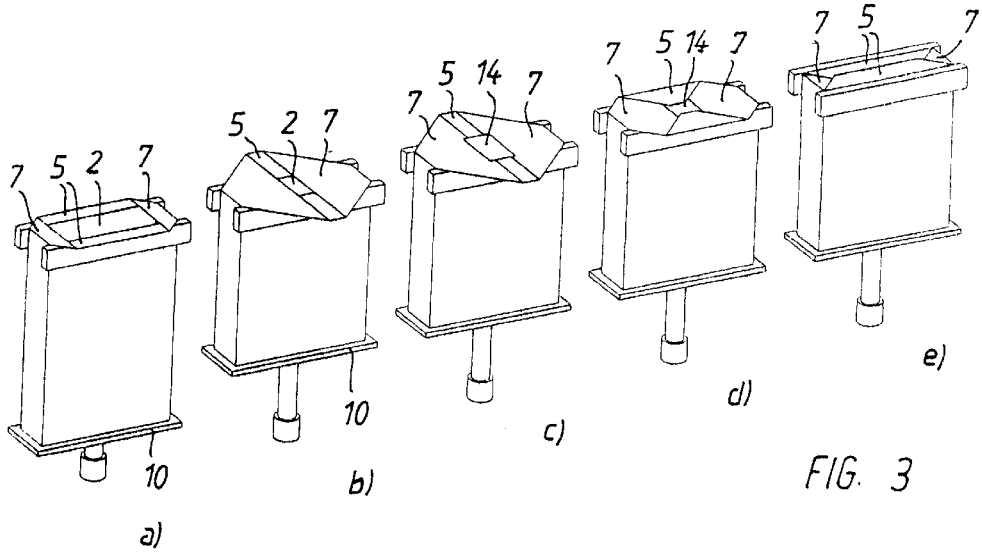
Figure 4:
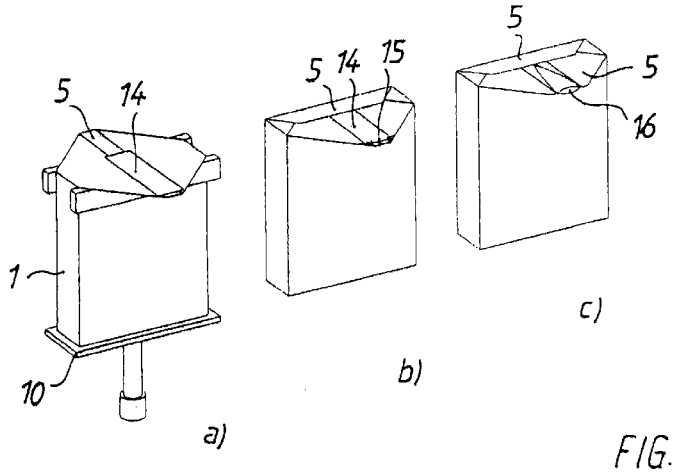
Figure 5:
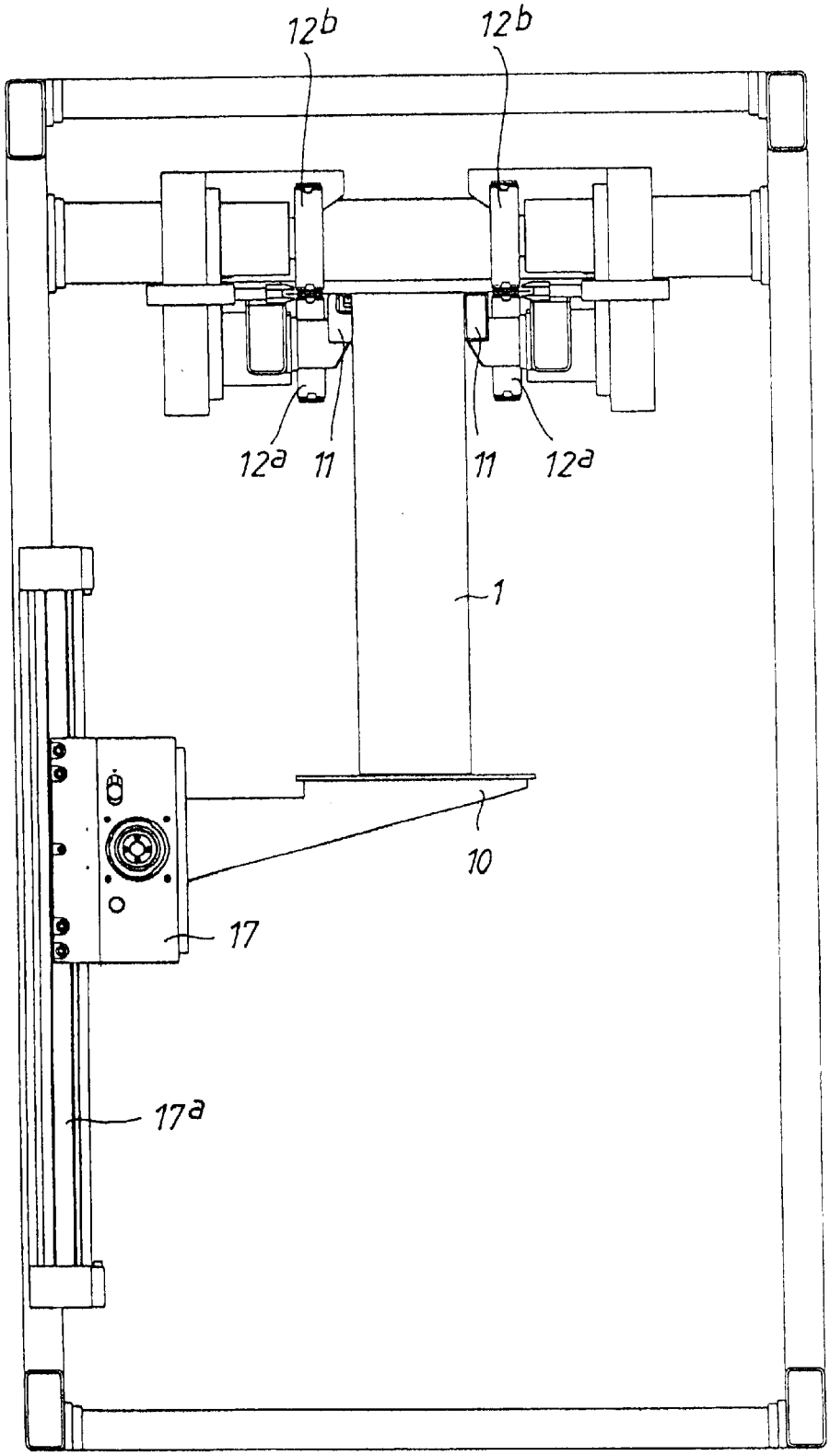
Figure 6:
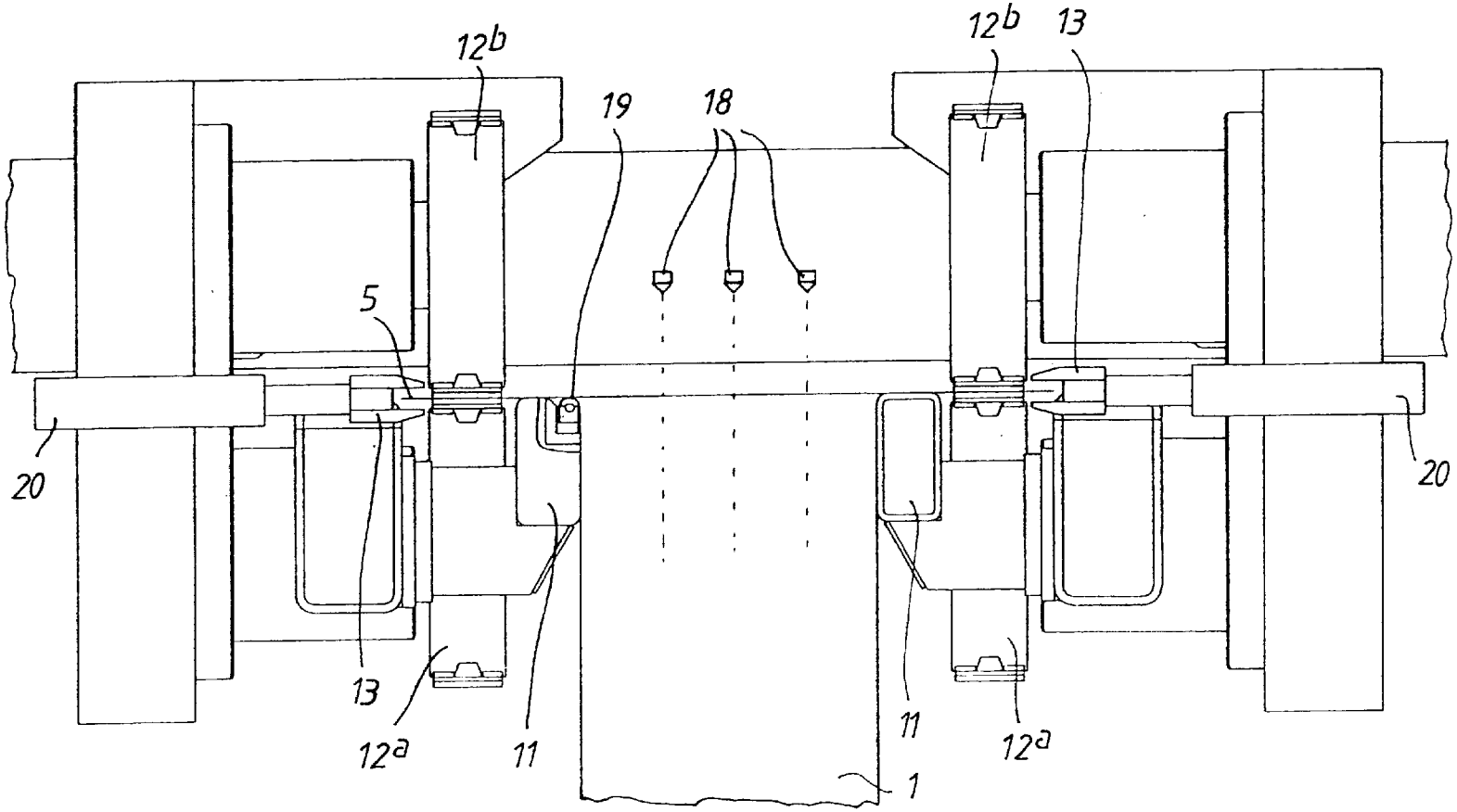
Figure 7:
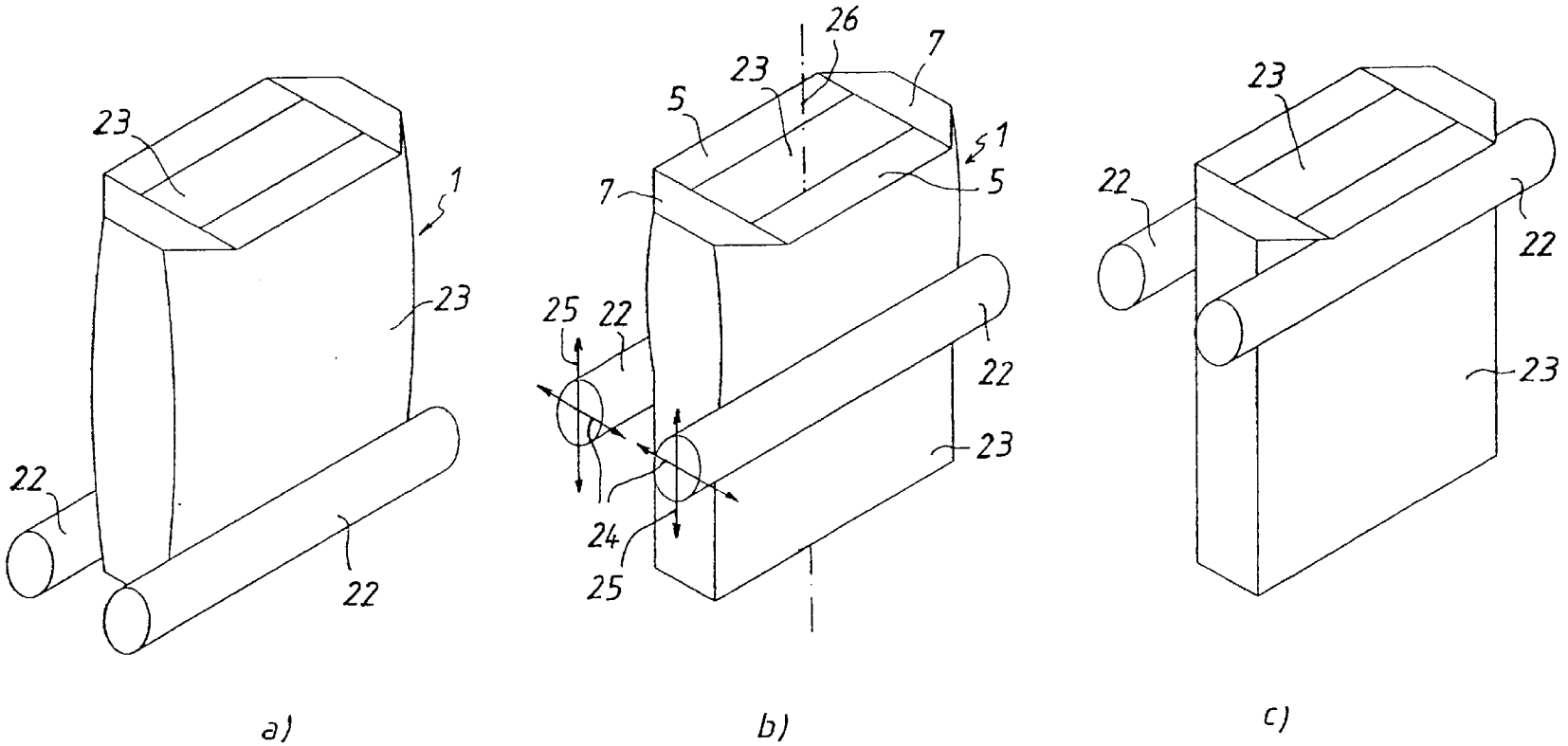
Figure 8:
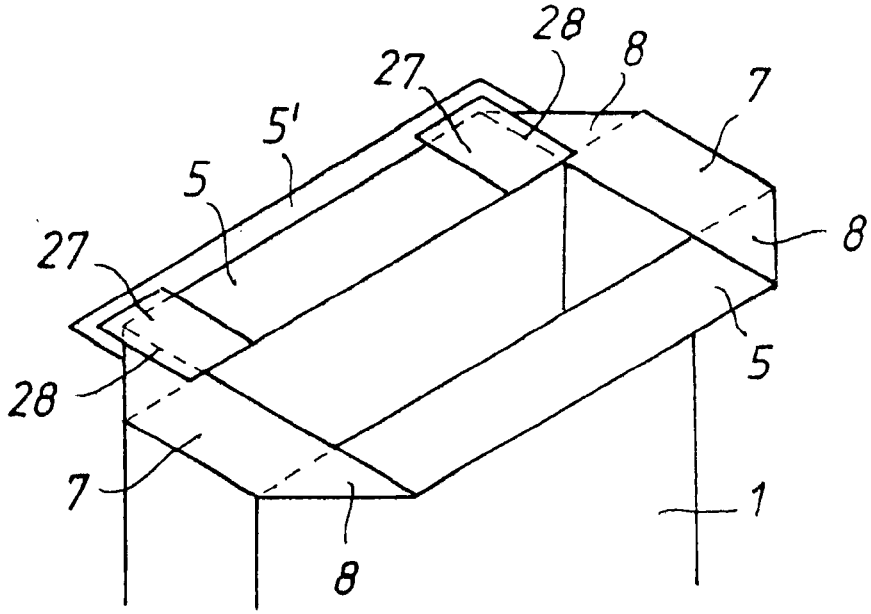

The invention is explained in greater detail hereinafter on the basis of the drawings. These show:

FIG. 1: A collared sack or bag according to the invention on an embodiment of the device according to the invention for the shortening of the sack or bag;

FIG. 2: A collared sack or bag in four sequential stages of the volume adjustment process, with subsequent closure;

FIG. 3: A collared sack or bag in five sequential stages of the volume adjustment process, with subsequent closure;

FIG. 4: A further embodiment of the process sequence for the closure of a collared sack or bag shortened according to the invention;

FIG. 5: A device for adjusting the sack or bag length to the filling content of the sack or bag;

FIG. 6: A detailed representation of this device in an enlarged scale;

FIG. 7: A device for reducing the cross-section of a collared sack or bag in diagrammatic representation and in three positions of the pressing tool;

FIG. 8: The upper part of a further embodiment of the collared sack or bag in a perspective representation; and FIG. 9: A representation as in FIG. 8, but with the adhesive trace marked in.

FIG. 1 shows a sack or bag 1 of rectangular cross-section, of which the collar 3, surrounding the opening 2, consists of two mutually opposed longer peripheral strips 5, folded outwards about the folding edges 4, and two mutually opposed shorter peripheral strips 7, folded inwards about the folding edges 6. Between the peripheral strips 5 and 7, the folding about the folding edges 9 forms double-layered gussets 8. The layers connected to the peripheral strips 5 and 7, forming the gusset 8, are not connected to one another on the surface, and in particular are not adhesively bonded. Their sole connection pertains by means of the folding edges 9. The sack or bag 1 stands on a sack or bag carrier 10, which can be raised vertically, corresponding to the reduction in the size of the sack or bag which is to be effected. With the embodiment shown, this device comprises, on both sides of the sack or bag body, an angular guide rail 11, on which the first peripheral strips 5 and the gusset 8 are in contact on the inside. Connected to the guide rails 11, to the outside, are a pair of conveyor belts 12*a*, 12*b* in each case, guided by rollers, of which one conveyor belt 12*a*is arranged beneath the peripheral strip 5, and the other conveyor belt 12*b* is arranged above the peripheral strip 5. The upper conveyor belt 12*b*, by being lowered, can be brought into clamping engagement with the peripheral strip 5, so that the collared sack or bag can be moved forwards horizontally, e.g. in the transport direction 21. Arranged outside the pairs of belts 12*a*, 12*b* are grip elements 13, capable of horizontal movement, which, as shown, engage at the peripheral strips 5, and are capable of drawing these apart in the direction of the arrow, if the conveyor belts 12*b* are not engaged with the peripheral strips 5. As can be seen, the drawing apart of the peripheral strips 5 has the effect of shortening the sack or bag, whereby the folding edges 4, 6 are moved onto one another in the direction of the sack or bag base and the inner edges of the second peripheral strips 7. The movements of the grip elements 13 in the direction of the arrow is synchronised with a stroke of the sack or bag carrier 10 of equal length. The grip elements 13 are therefore only required to apply the force which is required in the course of the shortening of the sack or bag for the reshaping of the superfluous sack or bag wall into the sack or bag collar 3. FIG. 1 shows, as cross-hatching, the hot-melt adhesive coating 5*a* on the sack or bag collar 3, which in the area of the peripheral strips 5 is located on the top side, and in the area of the peripheral strips 7 is located on the underside, in an area adjacent to or close to the edge x.

FIG. 2*a*) shows a filled sack or bag 1. The sack or bag is not completely filled, so that shortening occurs, as shown in FIG. 2*b*). The peripheral strips 5 are drawn outwards, being widened, whereby the sack or bag carrier 10 is raised by the same amount. In this situation, the second peripheral strips 7 are also widened, and the opening 2 has been reduced. In stage 2*c*), a cover sheet 14 has been laid on the opening 2 and the peripheral strips 5 and 7, after the peripheral strips 5 have had adhesive applied to them first. In stage 2*d*), the first peripheral strips 5 have been folded over and adhesively bonded to form the closure illustrated.

With the process sequence shown in FIG. 3, the representation a) shows the initial state of the filled sack or bag 1, which in this case, however, has a substantially larger air space in the head than the sack or bag shown in FIG. 2*a*). To eliminate this air space in the head, the first peripheral strips 5 are drawn substantially further apart and the sack or bag carrier 10 is raised correspondingly higher than is the case with the sack or bag in FIG. 2. As a result of this, the inside edges of the second peripheral strips 7 come into very close proximity, and the remaining opening 2 is relatively small. In the stage shown in FIG. 3*c*), a cover sheet 14 is adhesively bonded onto the remaining opening 2. The first peripheral strips 5 are then folded over inwards until they pass over the cover sheet 14 (FIG. 3*d*). The first peripheral strips are then folded over again and adhesively bonded, so that the same closure form is derived externally as in FIG. 2*d*).

The sack or bag representation shown in FIG. 4*a*) corresponds to the representation in FIG. 3*c*), whereby, however, a cover sheet 14 has been adhesively bonded on top, which not only covers the remaining opening 2, but extends as far as the outer edge of the peripheral strip 5, which projects forwards. With this sack or bag, by analogy with FIGS. 3*d*) and 3*e*), a sack or bag closure can be formed. If this closure is opened, by folding the closure strips outwards, corresponding to FIG. 4*b*), and cutting at the edge 15, a discharge opening 16 is obtained at that point, as can be seen from FIG. 4*c*). By folding back the peripheral strip 5, folded outwards, the sack or bag can be closed again so as to provide an odour-tight seal.

FIGS. 5 and 6 show the station of a filling and closure machine for collared sack or bags or bags, in which the adjustment of the sack or bag volume to the actual volume is effected. The sack or bag 1 stands on a carrier 10, which is located on a carriage 17. The carriage 17 can be moved vertically in a carriage guide 17*a*. With the embodiment shown, the longer peripheral strips 5 of the sack or bag collar are folded outwards at right angles and clamped in each case between a pair of belts 12*a*, 12*b*, as a result of which the sack or bag 1 is capable of being moved in the transport direction (perpendicular to the plane of the drawing). Arranged between the sack or bag 1 and the lower conveyor belts 12*a*, 12*b*, are support carriers 11, on the inner edges of which are located rollers 19, which facilitate the drawing inwards of the sack or bag wall into the plane of the collar or the peripheral strips 5, 7 respectively. On the outside of the pairs of conveyor belts 12*a*, 12*b*, one grip element 13 is provided in each case, which in FIGS. 5 and 6 is shown as being disengaged from the peripheral strips 5. The grip elements 13 can be closed, whereby they engage with the outer edge of the peripheral strip 5. This causes the upper pressure application belts 12*b* to be raised in synchrony. or shortly thereafter, so that they clear the peripheral strips 5. By means of the pneumatic motors 20, the peripheral strips 5 are then drawn apart from one another by means of the grip elements 13, in mutually opposed directions, whereby the collar formation as shown in FIGS. 2 and 3 of stage a) to stage b) takes place. With the movement of the grip elements 13 apart from one another, the lifting movement of the carriage 17 is coupled to the carrier 10, so that the weight of the sack or bag is accommodated by the carrier 10, and the pneumatic grip elements 13 need only carry out the minor sack or bag material shaping. Arranged above the opening of the sack or bag 1 are three ultrasonic sensors 18, which determine the actual filling height of the bulk material in the sack or bag, so that the drive units of the grip elements 13 and of the sack or bag carrier 10 can be controlled according to the path being followed.

FIG. 7 shows in diagrammatic representation a device for reducing the cross-section of a sack or bag 1, of which only one pair of rollers 22 is shown, which have the effect of pressure bodies on the two large mutually opposed side surfaces 23 of the sack or bag. The rotatably mounted rollers 22 are capable of movement horizontally in the direction of the arrows 24, so that, as a result of these, the sack or bag 1 can be pressed together as far as a desired distance between the side wall surfaces 23. In addition to this, the roller pair 22 is capable of vertical movement in accordance to the arrows 25, as can be seen from their different positions in FIGS. 7*a*) to *c*). In this situation, a pressing effect is applied progressively over the side walls 23, from bottom to top, and the volume of the sack or bag 1 is reduced accordingly, so that the bulk material fills the sack or bag completely. As can be seen, the curvature of the sack or bag sides 23 is eliminated in this situation, so that the closed sack or bag is better suited for stacking and loading onto pallets.

It is to be noted that the stand of rolls (not shown) of each roller 22 comprises a drive unit for the vertical movement of the roller, as well as a drive unit controlled by a filling level sensor for the horizontal movement corresponding to the arrow 24.

FIG. 8 shows the embodiment of the collared sack or bag in which one of the two first peripheral strips 5 undergoes widening 5' by gradated cutting, in such a way that one of the sack or bag wall layers projects above the other(s). This makes it possible for sheets 27 to be placed on the peripheral strips 5, 5', and the upper layer of the gusset 8 to be imposed and adhesively bonded or welded on, in such a way that the gap 28 between the upper side of the peripheral strip 5 and the upper layer of the gusset 8 is entirely covered and sealed. Accordingly, with the sack or bag 1 closed, the air connection between the two layers of the gusset 8 is blocked.

Figure 9:
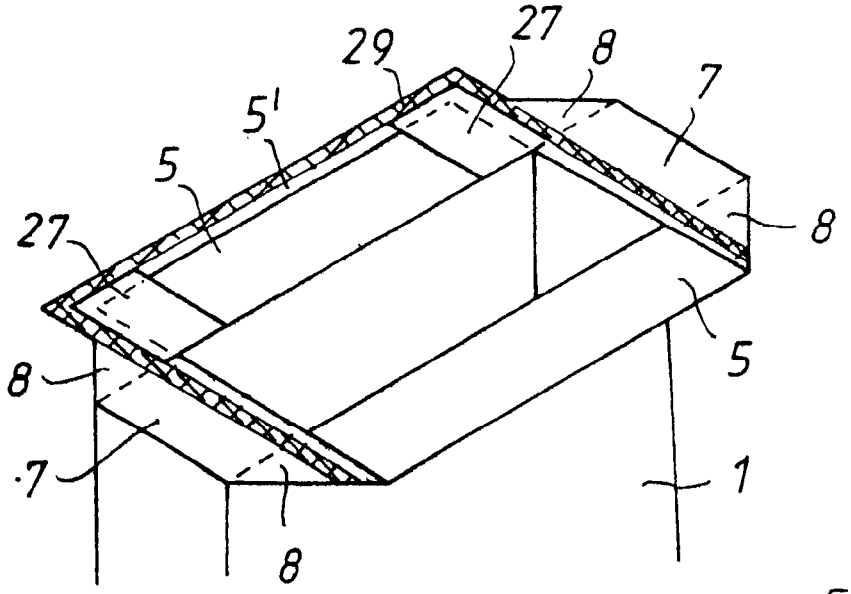

FIG. 9 accords with FIG. 8, whereby, however, the activatable adhesive trace 29 is marked in by cross-hatching. As can be seen, the adhesive trace runs on the widening section 5' over the gusset in contact 8, the second peripheral strip 7 folded inwards, and the additional gusset 8, located away from the widening section 5'. As can be seen, by folding one of the first peripheral strips 5, and then folding in the other, widened, first strip 5, 5', the sack or bag can be closed tight.

The term "folding edge" in the meaning of the present invention, in the case of sacks or bags made of plastic film, is also to be understood as a bending edge with a bending radius of about 1 cm or less.

What is claimed is:

1. A process for adjusting the volume of a collared sack, incompletely filled with bulk material, the collared sack having a collar with two mutually opposed first peripheral strips folded outwards, to the volume of bulk material located in the collared sack and two mutually opposed second peripheral strips transverse to the first peripheral strips, the method comprising:

drawing apart the first peripheral strips from one another wherein a collared sack wall is drawn from the upper part of the sack which remains unfilled, while folding edges of the second peripheral strips onto the collar to form a wider collar; and simultaneously with the drawing apart of the first peripheral strips, the collared sack is raised by the drawing distance of one of the peripheral strips.

2. The process according to claim 1 wherein the first peripheral strips are drawn apart laterally.

3. The process according to claim 1 wherein the first peripheral strips are drawn apart at an angle of 70° to 110°.

4. The process according to claim 1, wherein the first and second peripheral strips, after the first peripheral strips have been drawn apart, form mutually opposed four gussets and the four gussets are at least in part combined.

5. The process according to claim 4, wherein a hot melt adhesive located on the upper side of the first peripheral strips is thermally activated.

6. The process according to claim 5 wherein the first peripheral strips after being drawn apart are coated with adhesive and a cover sheet is laid on them.

7. The process according to claim 1 wherein the first peripheral strips are folded in, coated with adhesive, and again folded over and pressed to.

* * * * *